United States Patent [19]

Terada et al.

[11] Patent Number: 4,699,115

[45] Date of Patent: Oct. 13, 1987

[54] IGNITION APPARATUS FOR INTERNAL COMBUSTION ENGINES

[75] Inventors: Kanechiyo Terada; Toshihiro Saga, both of Kariya; Masahiro Koizumi, Kumamoto, all of Japan

[73] Assignee: Nippondenso Co., Ltd., Kariya, Japan

[21] Appl. No.: 858,723

[22] Filed: May 2, 1986

[30] Foreign Application Priority Data

May 3, 1985 [JP] Japan ..... 60-95758
May 21, 1985 [JP] Japan ..... 60-109104

[51] Int. Cl.[4] ..... F02P 3/08
[52] U.S. Cl. ..... 123/604; 123/335
[58] Field of Search ..... 123/604, 596, 335, 334; 315/209 CD

[56] References Cited

U.S. PATENT DOCUMENTS

| | | | |
|---|---|---|---|
| 3,599,616 | 8/1971 | Oishi et al. | 123/598 |
| 3,858,563 | 1/1975 | Roth | 123/604 |
| 3,972,315 | 8/1976 | Munden et al. | 123/604 |
| 4,345,576 | 8/1982 | Moseley et al. | 123/604 |
| 4,478,200 | 10/1984 | Nagashima et al. | 123/596 |
| 4,537,174 | 8/1985 | Nagasawa | 123/604 |

FOREIGN PATENT DOCUMENTS

| | | | |
|---|---|---|---|
| 52-57319 | 12/1977 | Japan . | |
| 2043166 | 10/1980 | United Kingdom | 123/604 |

*Primary Examiner*—Andrew M. Dolinar
*Attorney, Agent, or Firm*—Cushman, Darby & Cushman

[57] ABSTRACT

In the ignition apparatus for internal combustion engines, the internal combustion engine drives a generator and the generator charges a battery. The battery is connected to a boosting transformer which is connected with a semiconductor switch. The semiconductor switch causes a current to intermittently flow in the primary coil of the boosting transformer from the battery. An intermittence control circuit is connected between the semiconductor switch and the generator and controls the semiconductor switch to turn on and off a plurality of times per revolution of the generator in synchronism with the output of the generator. Thus, the semiconductor switch allows the transformer to generate a high voltage for ignition across the secondary coil. The intermittence control circuit includes an over-rotation preventing capacitor.

6 Claims, 6 Drawing Figures

IGNITION APPARATUS FOR INTERNAL COMBUSTION ENGINES

BACKGROUND OF THE INVENTION

This invention relates to an ignition apparatus for internal combustion engines which is of the capacitor discharge type using a battery as a DC power supply.

There is known an ignition apparatus of this type in which an oscillation-type DC-DC converter is used for boosting the output voltage of the battery and charging a capacitor (for example, U.S. Pat. No. 3,599,616 specification), and there is known another one in which a current from the battery is flowed in the primary coil of a boosting transformer in synchronism with an ignition signal and when reaching a constant value, the current is cut off to cause in the secondary coil thereof a high voltage, by which the capacitor is charged (for example, Japanese Utility Model Publication Gazette No. 57319/1977).

In the former one of the conventional ignition apparatus, however, the oscillation transformer of the oscillation-type DC-DC converter needs a ternary coil for self-oscillation in addition to the primary and secondary coils and thus it makes the apparatus complicated in construction. Also, since at high speed of engine, the capacitor must be charged enough, the oscillation frequency of the oscillation transformer is inevitably increased, causing radio-wave noise which aversely affects other electronic equipment. Since the number of times that the capacitor is charged per cycle of ignition is changed as the revolution rate of engine increases or decreases, the charged voltage across the capacitor changes with the change of the revolution rate of engine and as a result the ignition energy changes with the change of the revolution of engine. Moreover, since the oscillation circuit is required, the apparatus becomes large-sized and expensive.

In the latter one, since the primary current of the boosting transformer is controlled to start flowing by the ignition signal, a high voltage is only once induced per cycle of ignition, in the secondary coil of the boosting transformer and the capacitor is charged by the voltage induced once per cycle of ignition. Therefore, in order to obtain energy necessary to ignite by this single charging operation per cycle of ignition, the primary current of the boosting transformer and the number of turns of the primary coil must be increased to increase the electromagnetic energy ($\frac{1}{2}\cdot L\cdot I^2$) stored in the primary coil. Moreover, since the core of the boosting transformer must have a large cross-sectional area so that the magnetic flux produced in accordance with the ampareturn of the primary coil cannot saturate, the boosting transformer becomes large-sized. Also, since a large-capacity transistor is required for cutting off the primary current, the apparatus becomes large-sized and expensive. Furthermore, in the prior art, no consideration is made for the over-rotation prevention.

SUMMARY OF THE INVENTION

Accordingly, it is an object of this invention to provide an ignition apparatus for internal combustion engines which is small-sized, and inexpensive and can generate enough ignition energy over the range from high to low engine speed and prevent the over-rotation with simple construction.

According to this invention, since the primary current of the boosting transformer is intermitted a plurality of times per cycle of ignition in synchronism with the output of the continuity signal generating means, thus charging the ignition capacitor a plurality of times per cycle of ignition, it is possible to produce enough ignition energy with a small-sized and inexpensive arrangement over a range of low-speed to high-speed rotation of engine.

Moreover, since the over-rotation preventing capacitor is charged in synchronism with the continuity signal frequency from the continuity signal generating means and the semiconductor is stopped from intermittent operation by the charge and discharge of the over-rotation preventing capacitor when the continuity signal frequency exceeds a predetermined value, a high voltage upon over-ratation is prevented from being induced in the boosting transformer by the simple arrangement with only the over-rotation preventing capacitor added, and thus no ignition spark occurs so that the over-rotation can surely be prevented from occurence.

DESCRIPTION OF THE PREFERRED EMBODIMENTS

Figure 1:
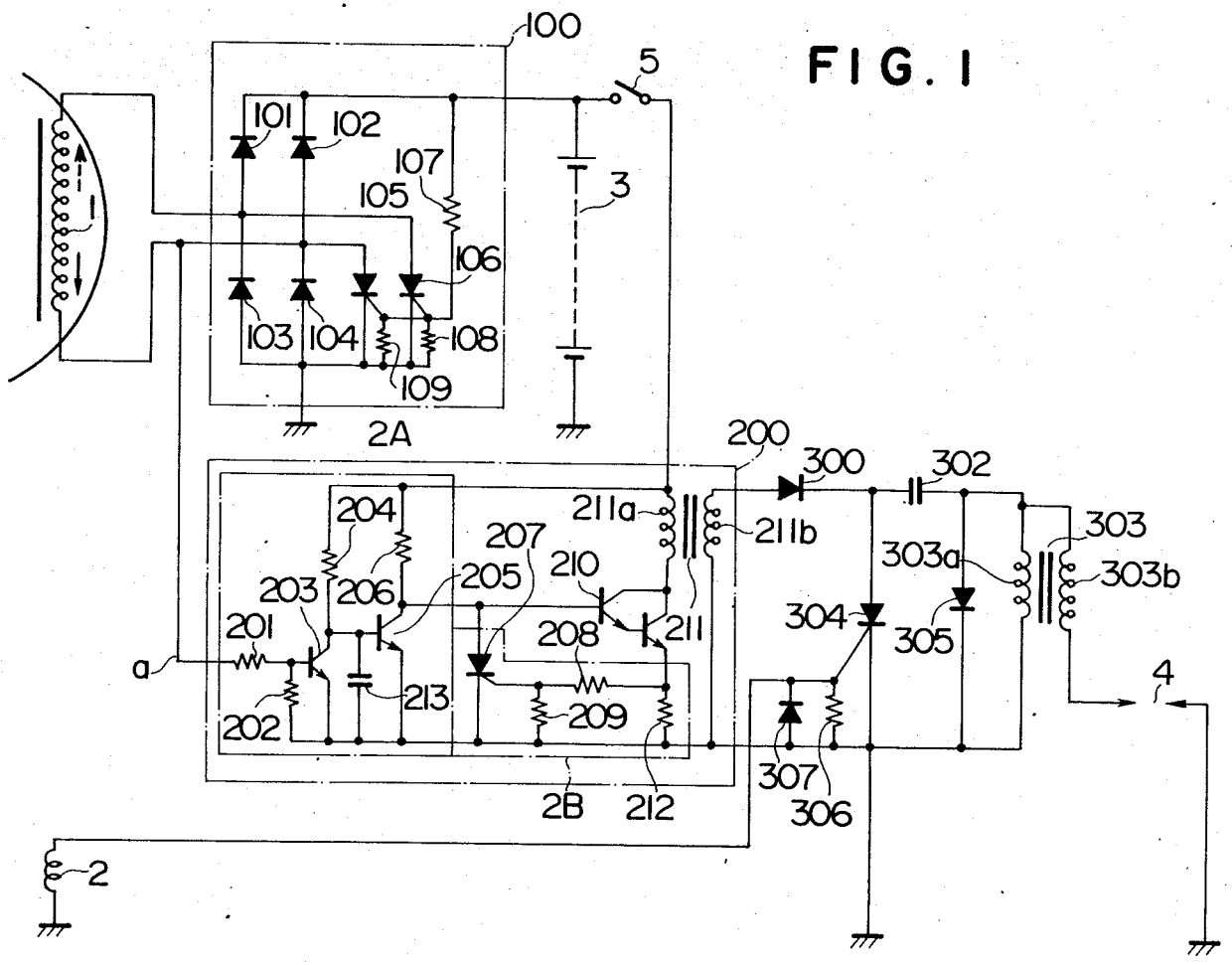
FIG. 1 is an electrical circuit diagram of one embodiment of an ignition apparatus according to this invention.

One embodiment of this invention will be described with reference to FIG. 1. Referring to FIG. 1, reference numeral 1 represents a power generation coil of a 12-pole magnet-type single-phase AC generator to be driven by an internal combustion engine. This coil 1 is used both as a battery charging source and as a continuity signal generating means. Reference numeral 2 denotes an ignition signal coil for generating an ignition signal in synchronism with the rotation of the internal combustion engine, 3 a battery, 4 an ignition plug, 5 a key switch, 100 a charging circuit for rectifying the full waves of the output from the power generation coil 1 and charging the battery 3, 101 to 104 rectifying diodes, 105 and 106 voltage-regulating thyristors and 107 to 109 regulated-voltage setting resistors. In addition, 200 represents a DC-DC converter including a continuity control circuit 2A and a cut-off control circuit 2B, 201, 202, 204 and 205 resistors, 203 and 205 a synchronizing transistor which operates upon continuity, 213 an over-rotation preventing capacitor, 207 a cut-off thyristor, 208 and 209 cut-off current setting resistors, 212 a primary current detecting resistor, 210 a power transistor serving as a semiconductor switching means, 211 a boosting transformer, **211*a* a primary coil thereof, and 211*b* a secondary coil thereof. Moreover, 301 designates a rectifying diode, 302 an ignition capacitor, 303 an ignition coil, 303*a* a primary coil thereof, 303*b* a secondary coil thereof, 304 an ignition thyristor serving as an ignition switching means, 305 a DC arc diode, 306 a resistor and 307** a diode.

Figure 2:
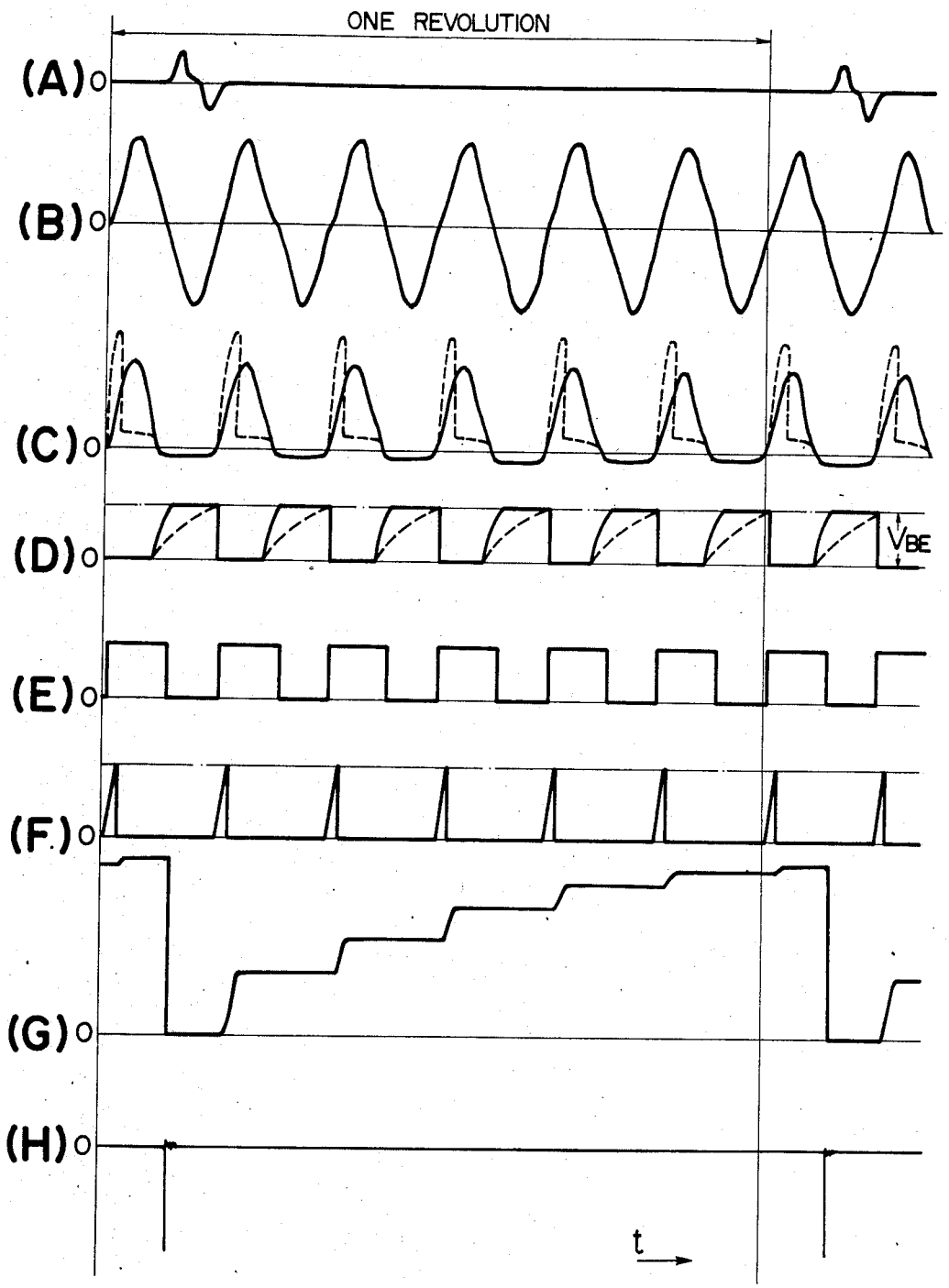
FIG. 2 is a waveform diagram useful for explaining the operation of the apparatus of FIG. 1.

FIG. 2 shows waveforms at respective portions of the circuit arrangement shown in FIG. 1. In FIG. 2, shown at A is a voltage generated in the ignition signal coil 2, B a no-load voltage generated in the power generation coil 1, and C working voltages in the coil 1 at point a in FIG. 1, the solid-line waveform being the voltage generated at a relatively low-speed rotating time when the voltage regulating thyristor 105 is not turned on, the broken-line waveform being the voltage generated at a relatively high-speed rotating time when the thyristor 105 is turned on, making voltage-regulating operation. Also, shown at D is a collector voltage of the transistor 203 (the voltage across the over-rotation preventing capacitor 213), and E a collector voltage of the transistor 205. Here, the resistors 201 and 202 are fixed in their values so that even at the time of the voltage regulating operation, the transistor 203 is prevented from greatly changing its on-width. Moreover, shown at F is a current flowing through the primary coil 211*a* of the boosting transformer 211, G a voltage across the ignition capacitor 302 charged, and H an igniting high voltage generated in the secondary coil 303*b* of the ignition coil 303.

The operation of the circuit arrangement of FIG. 1 will be described below. When the key switch 5 is closed, rotating the rotor of the magnet-type power generator, the power generation coil 1 generates a no-load AC voltage of 6 cycles per revolution of the rotor as shown in FIG. 2 at B. When the power generation coil 1 generates the voltage in the positive direction (as indicated by the solid arrow in FIG. 1), a current flows in the circuit of the coil 1→resistor 201→202 →ground→diode 103, and the voltage across the resistor 202 permits the transistor 203 to be conductive. When the transistor 203 is turned on, the over-rotation preventing capacitor 213 is instantly discharged, decreasing the base potential of the transistor 205 so that the transistor 205 is turned off. When the transistor 205 is turned off, a current is flowed from the battery 3 via the key switch 5 and resistor 206 to the base of the power transistor 210, turning on the transistor 210. Then, a current flows in the primary coil 211*a* of the boosting transformer 211 via the path of the battery 3→key switch 5→primary coil 211*a* of boosting transformer 211→power transistor 210→resistor 212. Thus, the voltage across the resistor 212 increases in proportion to the primary current. This voltage is divided by the resistors 208 and 209 and applied to the gate of the cut-off thyristor 207. Thus, the current flowing in the primary coil 211*a* of the boosting transformer 211 increases. When the voltage across the resistor 209 reaches a gate trigger voltage $V_{GT}$ of the cut-off thyristor 207, the thyristor 207 is turned on. Then, the base current of the power transistor 210 becomes zero as a result of current flow through the thyristor 207, thus the power transistor 210 being rapidly turned off to cut off the primary current in the boosting transformer 211. At this time, a high voltage is generated in the primary coil 211*a* by the inductance component of the primary coil 211*a* and also a boosted voltage as high as the primary voltage multiplied by the turn ratio is induced in the secondary coil 211*b*. This secondary voltage charges the capacitor 302 via the circuit path of the diode 301→ignition capacitor 302→diode 305.

When the magnet-type generator further rotates, generating a negative voltage (in the broken-arrow direction as shown in FIG. 1) in the coil 1, the base current of the transistor 203 becomes zero and thus the transistor 203 is turned off. Then, the over-rotation preventing capacitor 213 is charged by the battery 3 at the rate determined by the time constant of the resistor 204 and the capacitor 213 as shown at D in FIG. 2 by the solid line. When this voltage across the capacitor 213 reaches the base-emitter voltage $V_{BE}$ of the transistor 205, the transistor 205 is turned on, permitting a current to flow therethrough so that the thyristor 207 is turned off.

The above operations are repeated at each cycle of the positive and negative voltages in the power generation coil 1 and consequently as shown in FIG. 2 at G the ignition capacitor is charged six times per revolution of the magnet type generator.

Then, an ignition signal of one cycle per revolution of the magnet type generator is generated in the ignition signal coil 2 in synchronism with the rotation of the internal combustion engine as shown in FIG. 2 at A. When at the time of ignition a positive voltage is generated in the signal coil 2, the igniting thyristor 304 is turned on, making the ignition capacitor 302 discharged through the primary ocil 303*a* of the ignition coil 303. Thus, a high voltage is induced in the secondary coil 303*b*, and fed to the ignition plug 4.

Moreover, when the rotor of the magnet type generator rotates at high speed so that the voltage induced in the coil 1 exceeds the voltage of the battery 3, the charge circuit 100 charges the battery 3 together with the above operations.

Even when the rotor rotates at higher speed, making a higher voltage induced in the coil 1 so that the voltage at point a in FIG. 1 becomes as shown at C in FIG. 2 by the broken line as a result of the voltage regulating thyristor 105 being conducting, the ignition capacitor 302 is charged six times in synchronism with the rotation of the generator over the range of low to high speed, providing very stable ignition energy because the transistor 203 operates under properly selected values of resistors 201 and 202.

In addition, since the resistors 201 and 202 have values of several hundreds of Ω to several tens of kΩ, the battery charging voltage is almost not reduced even if the synchronizing signal to the DC-DC converter 200 is produced from the power generation coil 1.

Thus, since the ignition energy is produced by six cycles of charge of capacitor per ignition, the ignition energy per cycle of charge is small, or the necessary electromagnetic energy per cycle of charge may be small. As a result, the transformer 211 can be small-sized, and the power transistor 210 may be of low-current type. Thus, the capacitor charge type ignition system using a battery for power supply can be small-sized and produced at low cost.

The operation in the case where the internal combustion engine over-rotates will be described. The on-off operation period of the transistor 203 decreases as the engine speed increases, while the over-rotation preventing capacitor 213 is charged at the rate determined by a time constant of resistor 204 and capacitor 213 and thus the angular position at which the thyristor 207 is restored after the transistor 203 is turned off making the transistor 205 conductive is delayed as the rotation speed increases. Therefore, when the transistor 203 is turned off at a rotation speed of the engine just before the over-rotation, is predicted and the time constant of resistor 204 and capacitor 213 is specified so that at this off-time the charged voltage across the over-rotation preventing capacitor 213 does not reach the on-voltage $V_{BE}$ the transistor 205 as indicated in FIG. 2 at D. Thus, at the specified revolution rate or above, the transistor 205 is not turned on when the transistor 203 is turned off, and hence the thyristor 207 is maintained to be on since it is continuously supplied with current from the battery via resistor 206. Consequently, the base current of the power transistor 210 is not always flowed with the result that the cut-off operation ceases so as not to generate the secondary voltage. Thus, the engine speed cannot be increased further, prevented from the over-rotation.

Since the engine can be provided with the over-rotation preventing function by only adding the over-rotation preventing capacitor 213 to the basic circuit, the battery charge type ignition system with over-rotation preventing function can be produced in a small size and at low cost.

Figure 3:
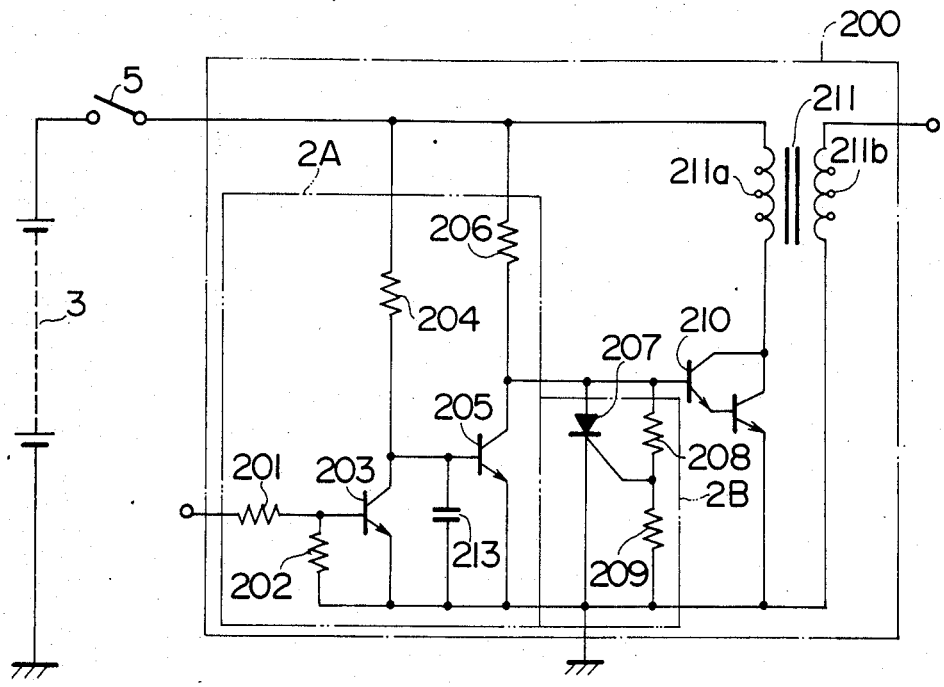
FIGS. 3 to 6 are electrical circuit diagrams of the second to fifth embodiments of this invention.

FIG. 3 shows a second embodiment of this invention. In this embodiment, instead of directly detecting the primary current of the boosting transformer 211 the base voltage of the power transistor 210 which corresponds to the primary current is detected by the resistors 208 and 209 in the cut-off control circuit 2B, and when this base voltage reaches a specified value, the primary current in the boosting transformer 211 is indirectly found to have reached constant value or above, and then the cut-off thyristor 207 is turned on.

Figure 4:
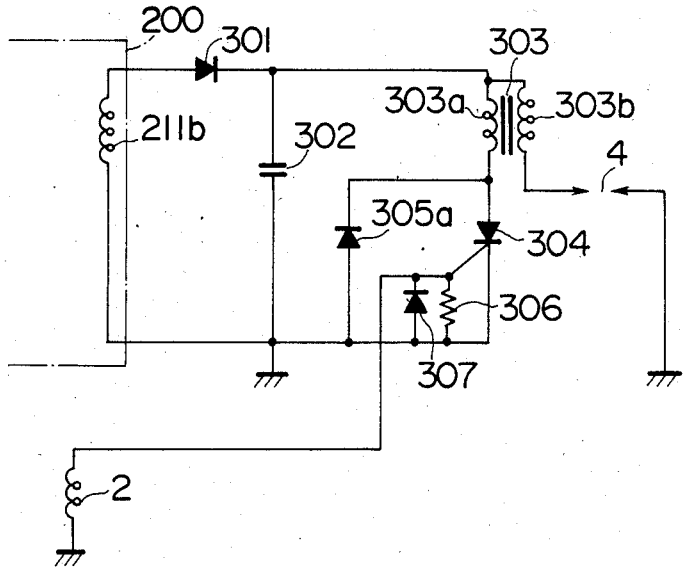

FIG. 4 shows a third embodiment of this invention. In this embodiment, a series circuit of the primary coil 303*a* of the ignition coil 303 and the ignition thyristor 304 is connected across the ignition capacitor 302, and an AC are diode 305*a* is connected in parallel to the thyristor 304 in which case its polarity is oposite to that of the thyristor.

Figure 5:
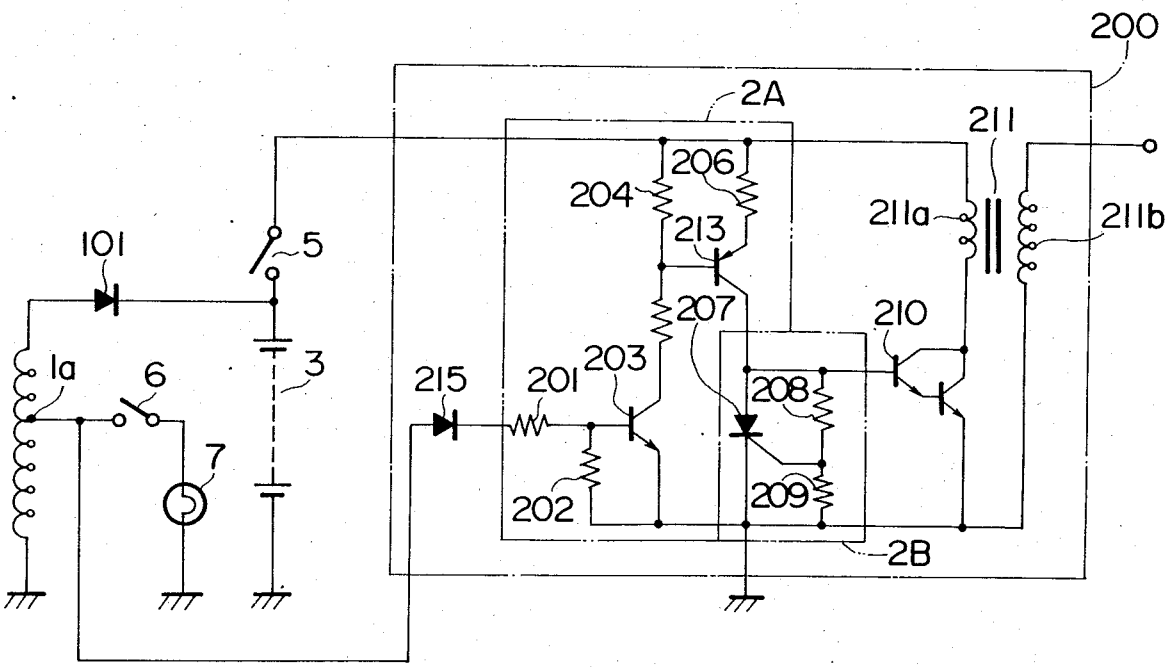

FIG. 5 shows a fourth embodiment of this invention. In this embodiment, a PNP transistor 213 in the continuity control circuit 2A is connected between the resistor 206 and the base of the power transistor 210, instead of the fact that the NPN transistor 203 is connected across the base-emitter path of the power transistor 210 as in the second embodiment. Also, the power generation coil 1 is provided with a mid tap 1*a*, from which a continuity control signal is supplied through the diode 215 to the continuity control circuit 2A and from which power is supplied to a lamp load 7 through an operating switch 6. Moreover, the voltage across the coil 1 is halfwave-rectified by a diode 101 and charges the battery 3.

Figure 6:
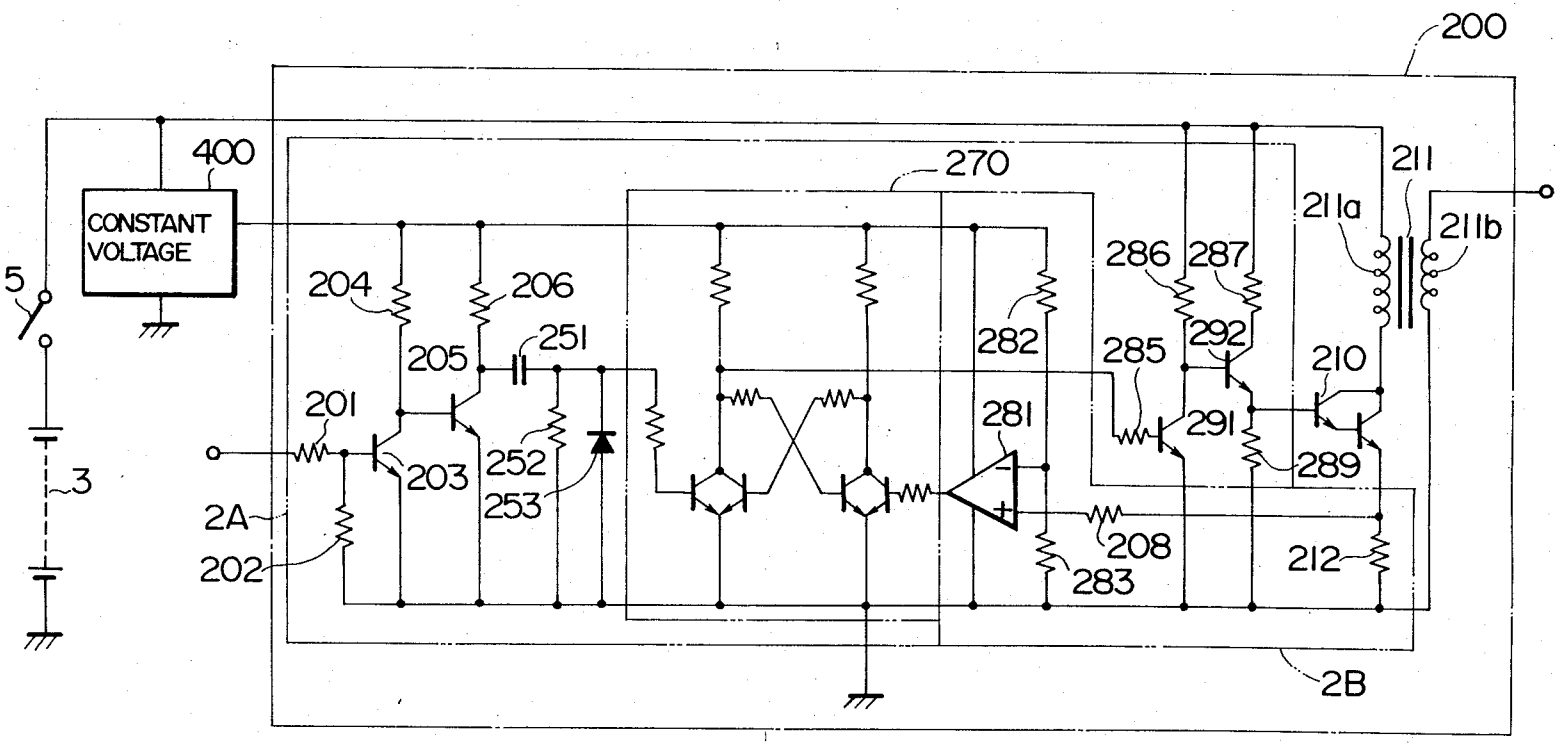

FIG. 6 shows a fifth embodiment of this invention. In this embodiment, the output voltage of the battery 3 is supplied through a constant voltage circuit 400 to the DC-DC convertor 200, and the collector output of the transistor 205 is differentiated by a differentiating circuit constituted by a capacitor 251, a resistor 252 and a diode 253. The differentiated output sets a flip-flop circuit 270. The output of the flip-flop circuit 270 is supplied through resistors 285 to 287 and transistor 291 and 292 to the base of the power transistor 210, making it conductive. When the primary current of the boosting transformer 211 which is detected by the current detecting resistor 212 exceeds a predetermined value set by the resistors 282 and 283, a comparator 281 produces a high-level output, resetting the flip-flop 270 so as to cut off the power transistor 210.

While in the above-mentioned embodiments, a 12-pole magnet type single-phase AC generator is used, a 4-pole or more magnet type single-phase AC generator may be used as a continuity signal generating means. Moreover, the AC generator may be a three-phase generator, an alternator with a field coil or a two-pole magnet generator as long as the positive and negative half-wave outputs are fullwave-rectified and make the power transistor 210 conductive. Also, the battery charging source and the continuity signal generating means may be separately provided.

Moreover, while in the above embodiments the ignition thyristor 304 is turned on by the ignition signal from the ignition signal coil 2, the ignition thyristor 304 can be turned on by the output of the electronic ignition control circuit.

Also, this invention may be used in a multi-cylinder internal combustion engine. In this case, the circuits except the boosting transformer 211 in the DC-DC converter 200 are used common to each cylinder, and the boosting transformers the number of which corresponds to that of the cylinders are intermitted in their primary currents by the single power transistor 210 so that high voltages are generated in the primary coils of the boosting transformers and charge the ignition capacitors of the cylinders the charges across which are supplied to the ignition coils of the cylinders.

We claim:

1. An ignition apparatus for internal combustion engines using a DC power supply of a battery to be charged by the output of a generator which is driven by an internal combustion engine to produce an AC output, comprising:

a boosting transformer having a primary coil connected to said battery and a secondary coil, for boosting an output voltage of said battery;

semiconductor switching means connected in series with the primary coil of said boosting transformer, for intermitting a current flowing through said primary coil from said battery;

an intermittance control circuit connected between the control electrode of said semiconductor switching means and said generator, for controlling said semiconductor switching means to make switching operation a plurality of times per revolution in synchronism with the output of said generator;

a capacitor connected to the secondary coil of said boosting transformer and charged by a voltage induced in said secondary coil;

ignition switching means connected to said capacitor and made conductive at ignition time; and an ignition coil having a primary coil and a secondary coil, said primary coil being connected in series with said ignition switching means and said capacitor to constitute a closed circuit and said secondary coil being provided to induce a high voltage for ignition when said ignition switching means is turned on to allow said capacitor to discharge through said secondary coil.

2. An ignition apparatus for internal combustion engines according to claim 1, wherein said intermittence control circuit is connected between a control electrode of said semiconductor switching means and said generator and includes a continuity control circuit for turning on said semiconductor switching means a plurality of times per revolution of said generator in synchronism with the output of said generator, and a cut-off control circuit for detecting a primary current of said boosting transformer and turning off said semiconductor switching means each time when said primary current exceeds a predetermined value.

3. An ignition apparatus for internal combustion engines according to claim 2, wherein said cut-off control circuit includes a thyristor having the anode connected to the control electrode of said semiconductor switching means, and a voltage detecting circuit for supplying a predetermined voltage to the gate of said thyristor to make said thyristor conductive when the primary current of said boosting transformer exceeds a predetermined value.

4. An ignition apparatus according to claim 1, wherein said primary coil of said boosting transformer, said capacitor and said ignition switching means constitute a closed circuit and said ignition switching means is connected in parallel with a diode.

5. An ignition apparatus according to claim 2, wherein said cut-off control circuit is a logic circuit connected to the control electrode of said semiconductor switching means and produces an output to cut off said semiconductor switching means when the primary current of the boosting transformer exceeds a perdetermined value.

6. An ignition apparatus for internal combustion engines using a DC power supply of a battery, comprising:

a boosting transformer having a primary coil connected to said battery and a second coil, for boosting the output voltage of said battery;

semiconductor switching means connected in series with the primary coil of said boosting transformer, for intermitting the current passing through the primary coil from said battery;

continuity signal generating means for generating a plurality of continuity signals per cycle of ignition in synchronism with the rotation of the internal combustion engine;

an intermittence control circuit connected between the control electrode of said semiconductor switching means and said continuity signal generating means, for controlling said semiconductor switching means to intermittently operate a plurality of times per/cycle of ignition in synchronism with the output of said continuity signal generating means, an over-rotation preventing capacitor connected to said intermittence control circuit for preventing said semiconductor switching means from being intermittently operated by said intermittence control circuit when the output frequency from said continuity signal generating means exceeds a predetermined value;

an ignition capacitor connected to said secondary coil of said boosting transformer and charged by a voltage induced in said secondary coil;

ignition switching means connected to said ignition capacitor and made conductive at the time of ignition; and an ignition coil having a primary coil connected in series with said ignition switching means and said ignition capacitor to form a closed circuit, and a secondary coil inducing a high voltage for ignition when said ignition switching means is made conductive to allow said ignition capacitor to discharge through said primary coil, wherein said intermittence control circuit includes a continuity control circuit connected between the control electrode of said semiconductor switching means and said continuity signal generating means, for supplying from said battery a control signal for turning on said semiconductor switching means a plurality of times per cycle of ignition in synchronism with the output of said continuity signal generating means, and a thyristor responsive to the primary current of said boosting transformer to allow the control signal from said continuity control circuit to pass therethrough, or to bypass said semiconductor switching means to turn it off each time when said primary current exceeds a predetermined value, and wherein said over-rotation preventing capacitor is connected to said continuity control circuit and charged and discharged in synchronism with a continuity signal from said continuity signal generating means, so that when the frequency of said continuity signal exceeds a predetermined value, a continuity holding current is continuously flowed from said continuity control circuit to said thyristor.

* * * * *